US008731229B2

(12) United States Patent
Miyata et al.

(10) Patent No.: US 8,731,229 B2
(45) Date of Patent: May 20, 2014

(54) SPEAKER UNIT AND ACTIVE SPEAKER DEVICE

(75) Inventors: Kouji Miyata, Kanagawa (JP); Makoto Kawabata, Tokyo (JP)

(73) Assignee: Sony Corporation (JP)

( * ) Notice: Subject to any disclaimer, the term of this patent is extended or adjusted under 35 U.S.C. 154(b) by 408 days.

(21) Appl. No.: 13/238,131

(22) Filed: Sep. 21, 2011

(65) Prior Publication Data

US 2012/0087517 A1 Apr. 12, 2012

(30) Foreign Application Priority Data

Oct. 6, 2010 (JP) ..... P2010-226276

(51) Int. Cl.
*H04R 25/00* (2006.01)

(52) U.S. Cl.
USPC ..... 381/396; 381/400; 381/412

(58) Field of Classification Search
USPC ..... 381/396, 398, 400, 404, 407.412, 381/423–424
See application file for complete search history.

(56) References Cited

U.S. PATENT DOCUMENTS

2006/0198548 A1 9/2006 Sasaki et al.
2010/0086169 A1 4/2010 Kaiya et al.

FOREIGN PATENT DOCUMENTS

JP 10-051884 A 2/1998
JP 3493600 B2 2/2004
JP 2006-229520 A 8/2006
WO 2008-059596 A1 5/2008

*Primary Examiner* — Suhan Ni
(74) *Attorney, Agent, or Firm* — Lerner, David, Littenberg, Krumholz & Mentlik, LLP

(57) ABSTRACT

A speaker unit performing sound output in proportion to electric current by current driving includes: a frame having an opening; a magnet arranged inside the frame and formed in an annular shape; a yoke including a shaft-shaped insertion arrangement portion which is inserted into a center of the magnet; a coil bobbin formed in a cylindrical shape; a coil wound around an outer peripheral surface of the coil bobbin; a damper having elasticity and connected between the frame and the coil bobbin; a cone connected to the coil bobbin at an inner peripheral portion and fixed to an opening edge of the opening of the frame at an outer peripheral portion, which vibrates with movement of the coil bobbin; and a sound absorbing material arranged inside the coil bobbin.

5 Claims, 6 Drawing Sheets

SPEAKER UNIT AND ACTIVE SPEAKER DEVICE

CROSS-REFERENCE TO RELATED APPLICATION

The present application claims priority from Japanese Patent Application No. JP 2010-226276 filed in the Japanese Patent Office on Oct. 6, 2010, the entire content of which is incorporated herein by reference.

FIELD

The present disclosure relates to a technical field concerning a speaker unit and an active speaker device. In particular, the present disclosure relates to a technical field of suppressing excessive increase of output in high-frequency domains by arranging a sound absorbing material inside a coil bobbin.

BACKGROUND

There exists an active speaker device including an amplifier and a speaker unit outputting sound amplified by the amplifier.

As the speaker unit, for example, there exists the one in which a magnetic circuit including a magnet, a yoke and a coil is used and sound amplified by the amplifier is outputted (refer to, for example, JP-A-2006-229520 (Patent Document 1)).

In such speaker unit, the yoke is arranged at the center of an annular magnet, a coil wound about an outer peripheral surface of a tubular coil bobbin is arranged in a magnetic gap formed between the yoke and the magnet. The coil bobbin can be moved with respect to the yoke in the state where part of the coil bobbin is fitted onto the yoke, a cone is attached to one end of the coil bobbin as well as a cap blocking an internal space of the coil bobbin is attached to one end of the coil bobbin. A flexible damper is also attached to the coil bobbin.

In the above speaker unit, the magnetic circuit is driven based on a sound signal outputted from the amplifier and the cone vibrates with the movement of the coil bobbin, then, sound is outputted. When the coil bobbin is moved, the damper is elastically deformed to thereby suppress excessive movement of the coil bobbin.

In such speaker units, there is a voltage-driven type speaker unit in which sound is outputted by voltage.

The voltage-driven type speaker unit is generally used, however, driving force for outputting sound depends on voltage in the voltage-driven type speaker unit, therefore, linearity between voltage and driving force is broken in many cases, which causes deterioration in sound quality due to the break in linearity.

For example, electric current hardly flows in the coil as a frequency domain becomes higher in the voltage-driven type speaker unit, therefore, output (electromagnetic force) is reduced in high-frequency domains.

In order to compensate the reduction of output in high-frequency domains, the cap with certain rigidity is attached to one end of the coil bobbin and resonance is generated in the vicinity of the cap to amplify vibration, which suppress the reduction of output in high-frequency domains.

In response to the above, there is a current-driven type speaker unit in which sound is outputted by electric current in the speaker units.

SUMMARY

When the drive method is changed to the current driving in the structure of the voltage-driven type speaker unit, the reduction of output in high-frequency domains occurring in the voltage-driven type does not occur in the current-driven type.

Accordingly, the output is excessively increased in the high-frequency domains in the current-driven type, which causes deterioration of sound quality in the high-frequency domains.

In view of the above, it is desirable to provide a speaker unit and an active speaker device capable of suppressing excessive increase of output in high-frequency domains and improving sound quality.

An embodiment of the present disclosure is directed to a speaker unit performing sound output in proportion to electric current by current driving, which includes a frame having an opening which opens at least to an output direction of sound, a magnet arranged inside the frame and formed in an annular shape, a yoke including a shaft-shaped insertion arrangement portion which is inserted into a center of the magnet and arranged there, a coil bobbin formed in a cylindrical shape and can be moved in an axial direction of the insertion arrangement portion in a state where part of the coil bobbin is fitted onto the insertion arrangement portion of the yoke, a coil wound around an outer peripheral surface of the coil bobbin and arranged in a magnetic gap formed by the magnet and the insertion arrangement portion of the yoke, a damper having elasticity and connected between the frame and the coil bobbin, a cone connected to the coil bobbin at an inner peripheral portion and fixed to an opening edge of the opening of the frame at an outer peripheral portion, which vibrates with movement of the coil bobbin, and a sound absorbing material arranged inside the coil bobbin.

Therefore, air compressed in an internal space in accordance with the movement of the coil bobbin is absorbed by the sound absorbing material in the speaker unit.

It is preferable in the speaker unit that the sound absorbing material is provided as a cap attached to the coil bobbin and blocking the internal space of the coil bobbin from the opposite side of the insertion arrangement portion.

As the sound absorbing material is provided as the cap attached to the coil bobbin and blocking the internal space of the coil bobbin, resistance of air existing around the coil bobbin is maintained.

It is preferable in the speaker unit that the sound absorbing material is attached to one end surface of the insertion arrangement portion in the axial direction, and a cap for blocking the internal space of the coil bobbin is attached to one end surface of the coil bobbin in the axial direction or the cone.

As the sound absorbing material is attached to one end surface of the insertion arrangement portion in the axial direction, and the cap for blocking the internal space of the coil bobbin is fixed to one end surface of the coil bobbin in the axial direction or the cone, resistance of air existing around the coil bobbin is maintained.

It is preferable in the speaker unit that foamed materials having pores inside are used as the sound absorbing material.

As foamed materials having pores inside are used as the sound absorbing material, compressed air can be positively absorbed.

Another embodiment of the present disclosure is directed to an active speaker device including an amplifier performing sound output in proportion to electric current by current driving, and a speaker unit performing sound output amplified by the amplifier, in which the speaker unit performing sound output in proportion to electric current by current driving includes a frame having an opening which opens at least to an output direction of sound, a magnet arranged inside the frame and formed in an annular shape, a yoke including a shaft-shaped insertion arrangement portion which is inserted into a center of the magnet and arranged there, a coil bobbin formed in a cylindrical shape and can be moved in an axial direction of the insertion arrangement portion in a state where part of the coil bobbin is fitted onto the insertion arrangement portion of the yoke, a coil wound around an outer peripheral surface of the coil bobbin and arranged in a magnetic gap formed by the magnet and the insertion arrangement portion of the yoke, a damper having elasticity and connected between the frame and the coil bobbin, a cone connected to the coil bobbin at an inner peripheral portion and fixed to an opening edge of the opening of the frame at an outer peripheral portion, which vibrates with movement of the coil bobbin, and a sound absorbing material arranged inside the coil bobbin.

Therefore, air compressed in an internal space in accordance with the movement of the coil bobbin is absorbed by the sound absorbing material in the active speaker device.

The speaker unit according to the embodiment of the present disclosure performs sound output in proportion to electric current by current driving, which includes the frame having an opening which opens at least to the output direction of sound, the magnet arranged inside the frame and formed in an annular shape, the yoke including the shaft-shaped insertion arrangement portion which is inserted into the center of the magnet and arranged there, the coil bobbin formed in a cylindrical shape and can be moved in the axial direction of the insertion arrangement portion in the state where part of the coil bobbin is fitted onto the insertion arrangement portion of the yoke, the coil wound around the outer peripheral surface of the coil bobbin and arranged in the magnetic gap formed by the magnet and the insertion arrangement portion of the yoke, the damper having elasticity and connected between the frame and the coil bobbin, the cone connected to the coil bobbin at the inner peripheral portion and fixed to an opening edge of the opening of the frame at the outer peripheral portion, which vibrates with movement of the coil bobbin, and the sound absorbing material arranged inside the coil bobbin.

As the sound absorbing material is arranged inside the coil bobbin, excessive increase of output in high-frequency domains does not occur in the current-driven type, which can improve sound quality in the high-frequency domains.

According to the embodiment of the present disclosure, the sound absorbing material may be provided as the cap attached to the coil bobbin and blocking the internal space of the coil bobbin from the opposite side of the insertion arrangement portion.

As the sound absorbing material functioning as the cap blocking the sealed internal space is arranged inside the coil bobbin, oscillation in the lowest resonance frequency domain is suppressed and sound quality can be further improved.

According to the embodiment of the present disclosure, the sound absorbing material may be attached to one end surface of the insertion arrangement portion in the axial direction, and the cap for blocking the internal space of the coil bobbin is attached to one end surface of the coil bobbin in the axial direction or the cone.

As the cap for blocking the internal space of the coil bobbin is provided inside the coil bobbin, oscillation in the lowest resonance frequency domain is suppressed and sound quality can be further improved.

According to the embodiment of the present disclosure, foamed materials having pores inside may be used as the sound absorbing material.

Therefore, sound quality can be improved without causing the rise in manufacturing costs.

The active speaker device according to the embodiment of the present disclosure includes the amplifier performing sound output in proportion to electric current by current driving and the speaker unit outputting sound amplified by the amplifier, in which the speaker unit performing sound output in proportion to electric current by current driving includes the frame having the opening which opens at least to the output direction of sound, the magnet arranged inside the frame and formed in an annular shape, the yoke including the shaft-shaped insertion arrangement portion which is inserted into the center of the magnet and arranged there, the coil bobbin formed in a cylindrical shape and can be moved in the axial direction of the insertion arrangement portion in the state where part of the coil bobbin is fitted onto the insertion arrangement portion of the yoke, the coil wound around the outer peripheral surface of the coil bobbin and arranged in the magnetic gap formed by the magnet and the insertion arrangement portion of the yoke, the damper having elasticity and connected between the frame and the coil bobbin, the cone connected to the coil bobbin at the inner peripheral portion and fixed to the opening edge of the opening of the frame at the outer peripheral portion, which vibrates with movement of the coil bobbin, and the sound absorbing material arranged inside the coil bobbin.

As the sound absorbing material is arranged inside the coil bobbin, excessive increase of output in high-frequency domains does not occur in the current-driven type, which can improve sound quality in the high-frequency domains.

DETAILED DESCRIPTION

Hereinafter, a speaker unit and an active speaker device according to an embodiment of the present disclosure will be explained with reference to the attached drawings.

In the embodiment shown below, the technology is applied to an active speaker device in which a digital music player (DMP) is loaded and sound of the DMP is outputted and a speaker unit included in the active speaker device.

However, the application range of the present disclosure is not limited to the active speaker device outputting sound of the DMP and the speaker unit included in the active speaker device. The present disclosure can be widely applied to other various types of active speaker devices and speaker units included therein as long as they are the current-driven type active speaker device and the speaker unit included therein.

In the following explanation, directions of up, down, front, back, left and right are shown by determining a direction toward which the speaker unit of the active speaker device faces as a front direction.

The directions of up, down, front, back, left and right are shown for convenience of explanation, and the present disclosure is not limitedly applied to the directions.

[Whole Configuration]

Figure 1:
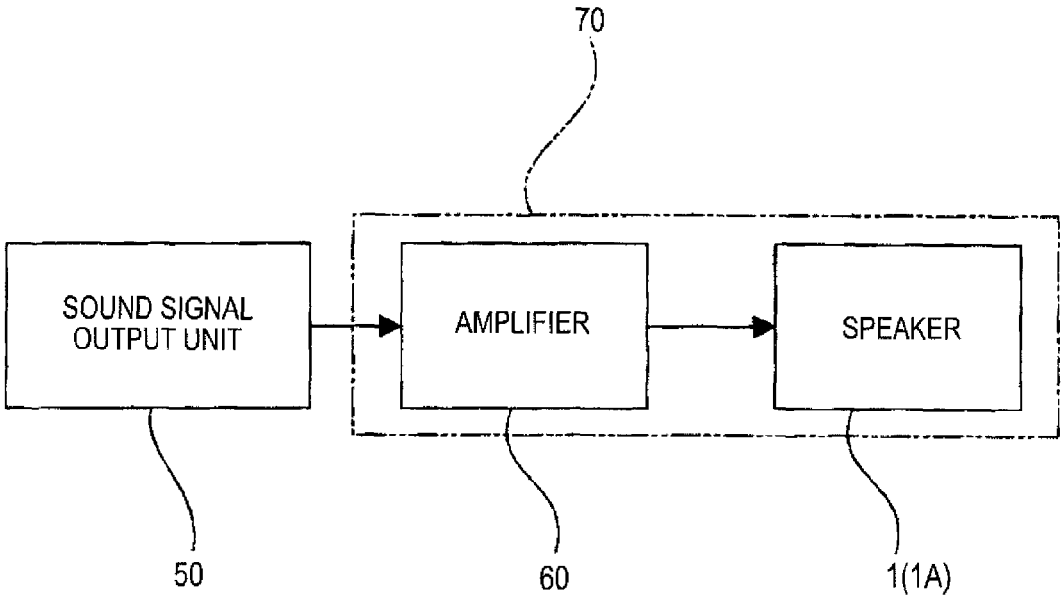
FIG. 1 shows an embodiment of the present disclosure with FIG. 2 to FIG. 6, which is a block diagram of a sound output device.

A speaker unit 1 has a function of outputting sound outputted from a sound signal output unit 50 such as a digital music player (DMP) and a disc player through an amplifier 60 (refer to FIG. 1).

Sound outputted from the audio signal output unit 50 is amplified by the amplifier 60 and outputted from the speaker unit 1. In the amplifier 60, sound output in proportion to electric current is performed by current driving.

An active speaker device 70 includes the amplifier and the speaker unit 1. It is preferable to that the active speaker device 70 includes plural speaker units 1.

The speaker unit 1 is included in the active speaker unit 70 with the amplifier 60.

[Structure of the Active Speaker Device]

Figure 2:
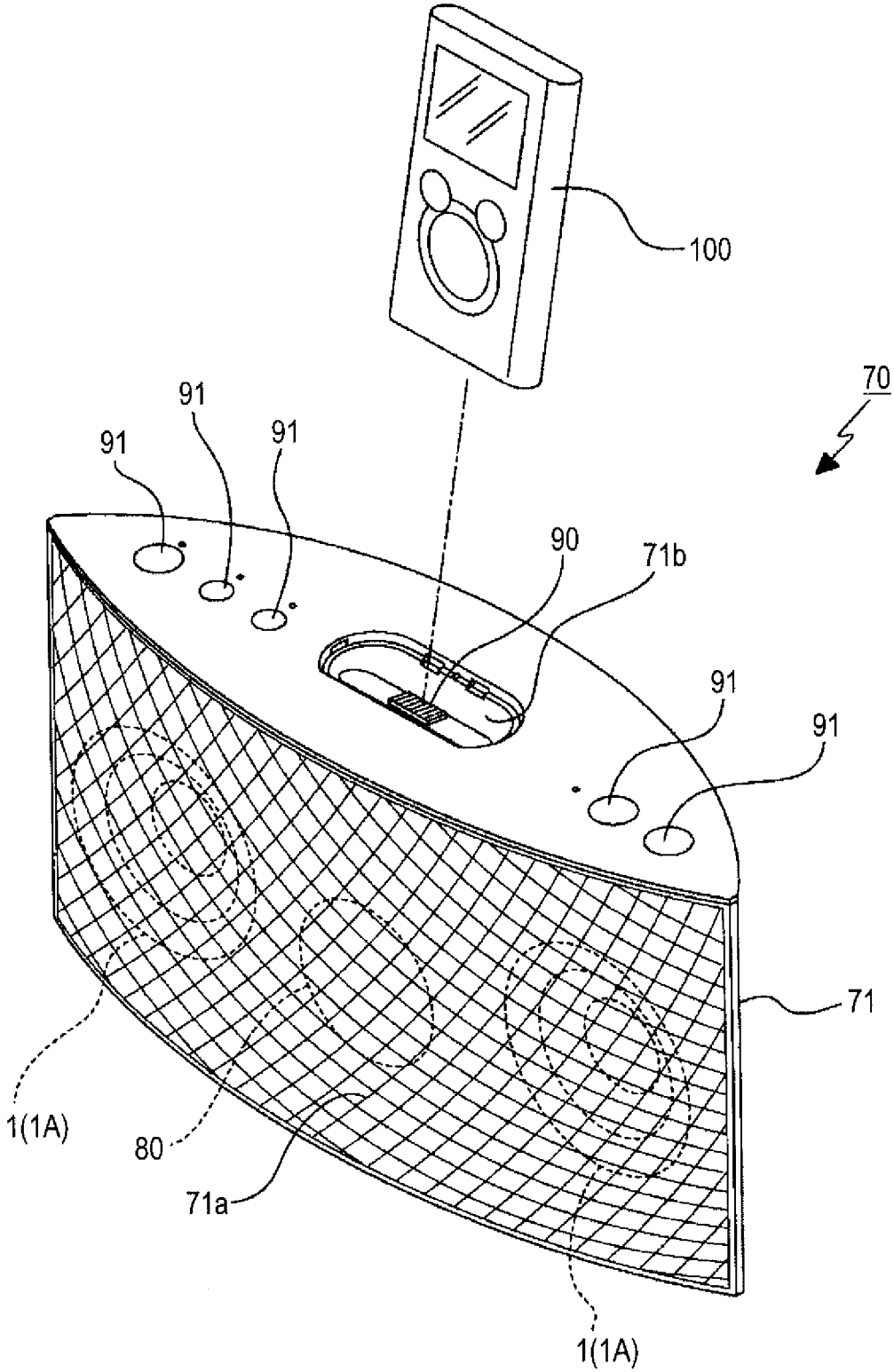
FIG. 2 is a perspective view showing an active speaker device with a digital music player.

The active speaker device 70 includes a casing 71 and necessary respective parts arranged inside the casing 71 and on an outer surface side of the casing 71 (refer to FIG. 2).

On a front surface portion of the casing 71, a grill net 71*a* is formed.

The speaker units 1, 1 are arranged inside the casing 71 with an interval in a right-and-left direction. A not-shown sound path as a path for sound is formed inside the casing 71, and a sound output unit 80 called a bass reflex connecting to the sound path is arranged between the speaker units 1, 1. The sound output unit 80 has a function of enhancing bass sound.

A not-shown circuit substrate is arranged inside the casing 71. In the circuit substrate, an amplifier circuit functioning as the amplifier 60 is formed.

A loading hole 71*b* is formed at the center in the right and left direction on an upper surface portion of the casing 71 and a connector 90 is arranged in the loading hole 71*b*. On the upper surface portion of the casing 71, plural operation buttons 91, 91, . . . are arranged.

A digital music player (sound signal output unit 50) 100 is loaded in the loading hole 71*b* of the casing 71, and a not-shown connection terminal of the loaded digital music player 100 is connected to the connector 90.

As the connection terminal of the digital music player 100 is connected to the connector 90, sound outputted from the digital music player 100 can be outputted from the speaker units 1, 1 and the sound output unit 80.

[Specific Structure of the Speaker Unit]

Figure 3:
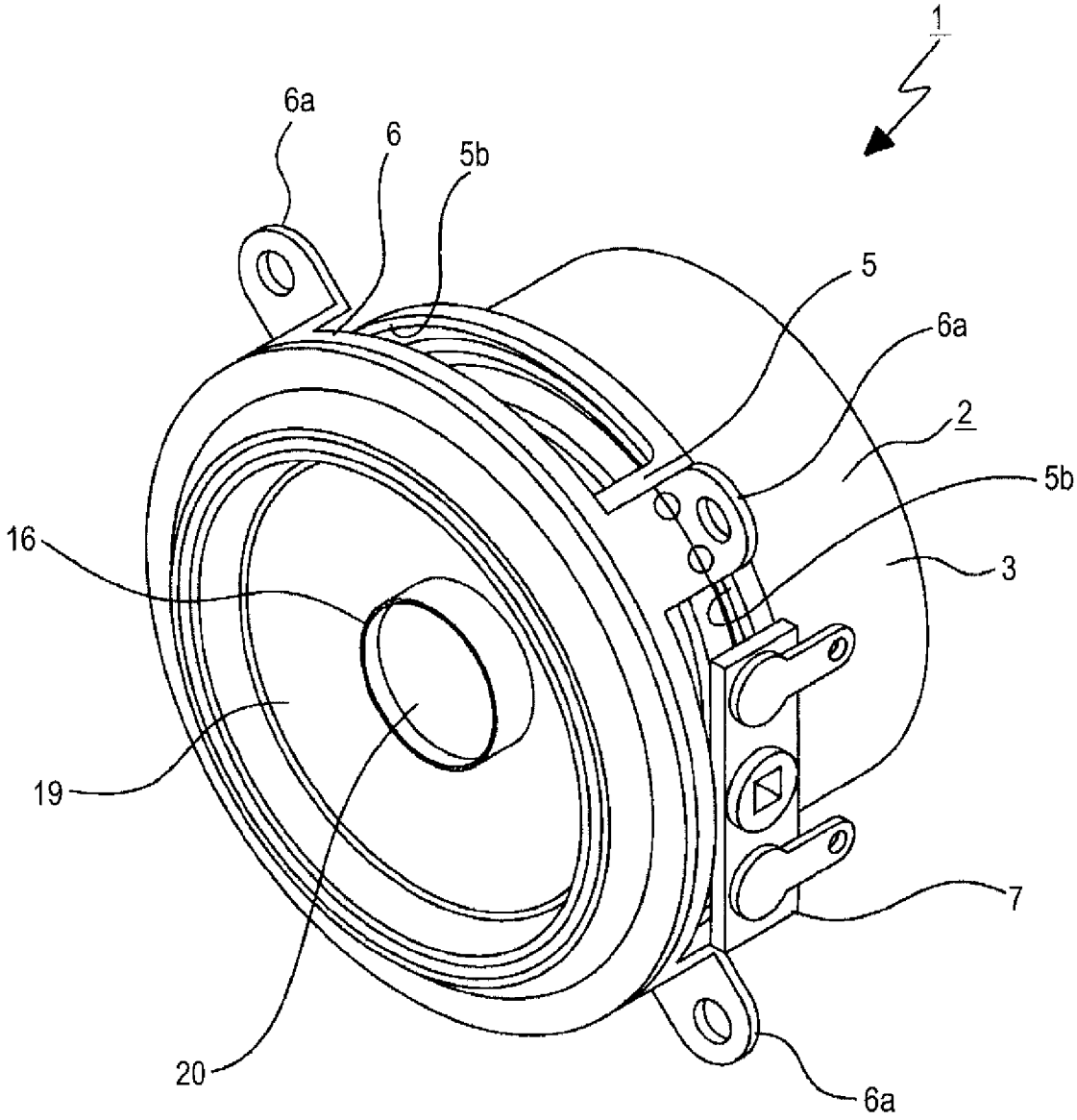
FIG. 3 is an enlarged perspective view of a speaker unit.
Figure 4:
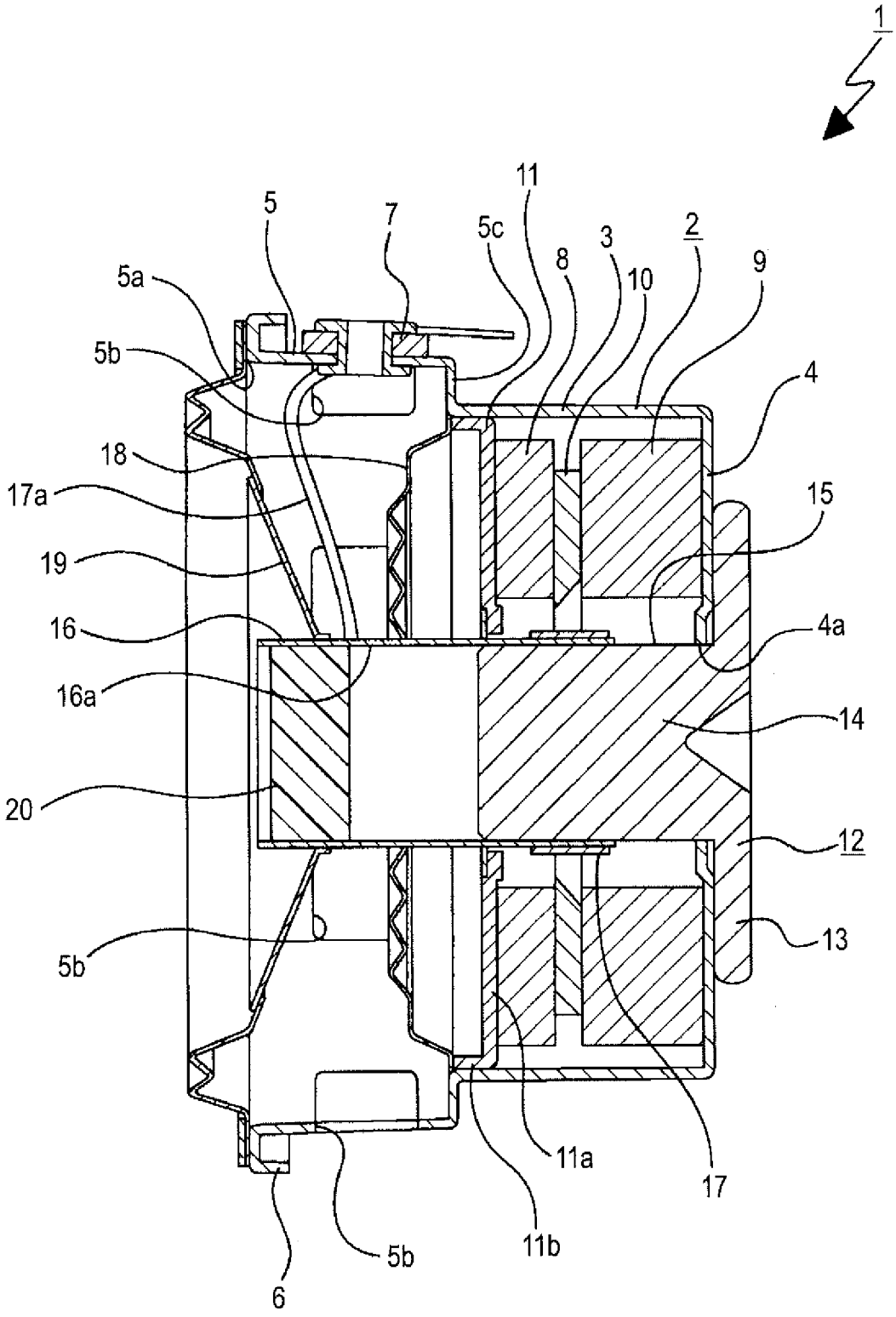
FIG. 4 is an enlarged cross-sectional view of the speaker unit.
Figure 5:
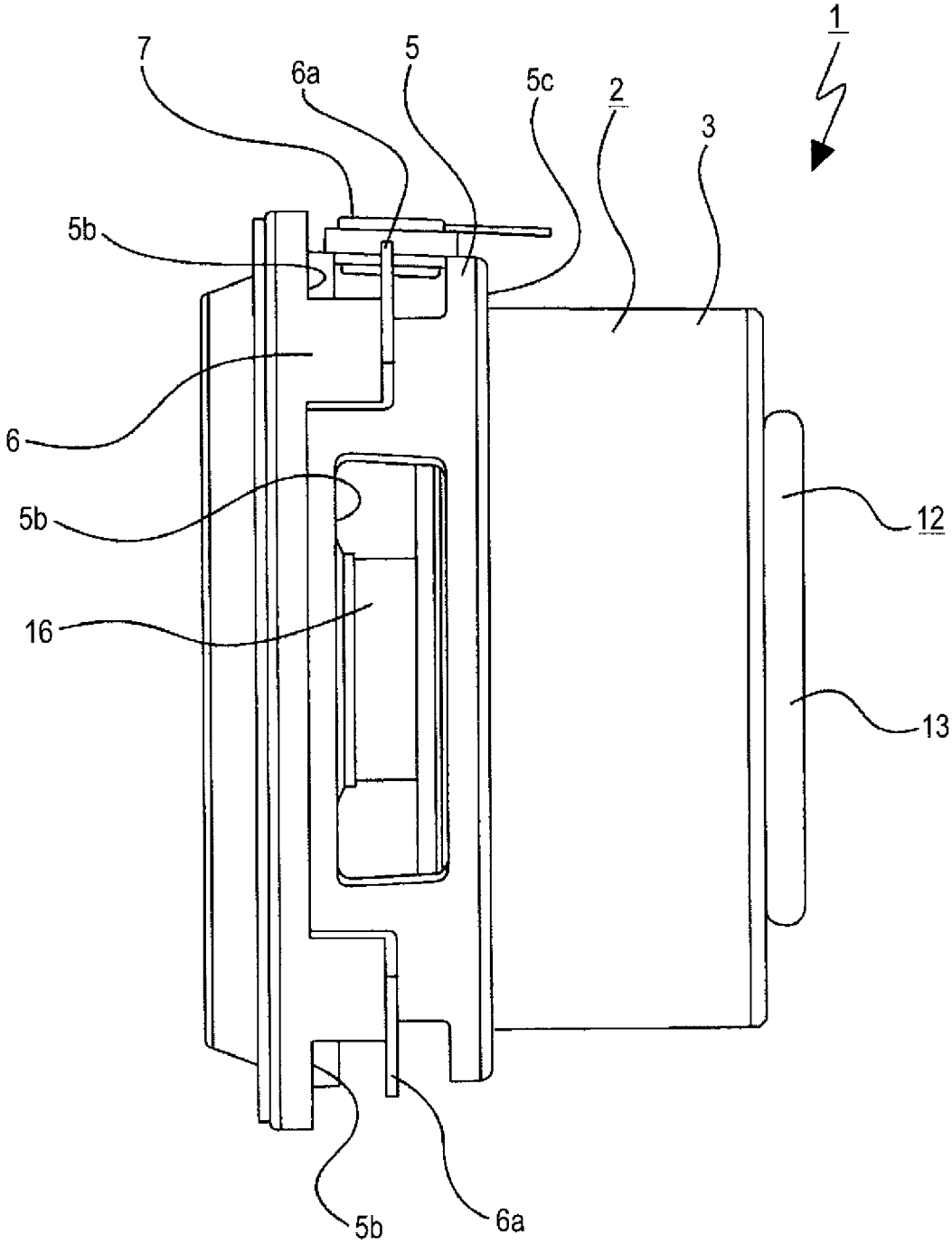
FIG. 5 is an enlarged side view of the speaker unit.

The speaker unit 1 includes necessary respective parts arranged inside a frame 2 (refer to FIG. 3 to FIG. 5).

The frame 2 includes a small-diameter base portion 3 formed to have a cylindrical shape, a bottom portion 4 extending inward from an rear edge of the small-diameter base portion 3, a large-diameter base portion 5 connecting to a front edge of the small-diameter base portion 3 and protruding forward and a folded portion 6 formed to be folded 180 degrees from a front edge of the large-diameter base portion 5.

A central hole of the bottom portion 4 is formed as an insertion hole 4*a*.

The large-diameter base portion 5 has a slightly larger diameter than the small-diameter base portion 3, which is connected to the front edge of the small-diameter base portion 3 through a step 5*c* facing front and back directions. Plural communicating holes 5*b*, 5*b*, . . . are formed on the large-diameter base portion 5 at equal intervals in a circumferential direction. The large-diameter base portion 5 has an opening 5*a* opening to a front direction, namely, an output direction of sound.

A terminal 7 is attached to an outer surface of the large-diameter base portion 5. The terminal 7 is provided as a terminal portion performing connection to the amplifier 60.

Mounting pieces 6*a*, 6*a*, . . . are provided on the folded portion 6 at equal intervals in the circumferential direction, and the mounting pieces 6*a*, 6*a*, . . . protrude outward. The speaker unit 1 is fixed to not shown mounting portions of the active speaker device 70 with the mounting pieces 6*a*, 6*a*, . . . , for example, being screwed.

Inside the small-diameter base portion 3, a first magnet 8 and a second magnet 9 both formed in an annular shape are arranged with an interval in a front-and-back direction (refer to FIG. 4). An annular plate 10 is arranged between the first magnet 8 and the second magnet 9, a rear surface of the first magnet 8 is fixed to a front surface of the plate 10 as well as a front surface of the second magnet 9 is fixed to a rear surface of the plate 10. A rear surface of the second magnet 9 is fixed to the bottom portion 4 of the frame 2.

A sub-plate 11 is fixed on an upper surface of the first magnet 8. The sub-plate 11 includes a base portion 11*a* and a fixing protrusion 11*b* protruding forward from an outer peripheral portion of the base portion 11*a*, and the fixing protrusion 11*b* is fixed to an inner peripheral surface at a front end of the small-diameter base portion 3.

The first magnet 8, the second magnet 9, the plate 10 and the sub-plate 11 are connected in a coaxial state and arranged inside the small-diameter base portion 3.

A yoke 12 is fixed to a rear surface of the bottom portion 4 of the frame 2. The yoke 12 includes an approximately disk-shaped base surface portion 13 and an insertion arrangement portion 14 protruding forward from the center of the base surface portion 13 which are integrally formed, in which the insertion arrangement portion 14 is formed in an approximately column shape.

A front surface of the base surface portion 13 in the insertion arrangement portion 14 is fixed to a rear surface of the bottom portion 4, and the insertion arrangement portion 14 is inserted inside the frame 2 from an insertion hole 4*a* of the bottom portion 4. The insertion arrangement portion 14 is arranged inside the small-diameter base portion 3 in a state of being inserted through a center hole of the second magnet 9, a center hole of the plate 10, a center hole of the first magnet 8 and a center hole formed in the base portion 11*a* of the sub-plate 11.

A space between the insertion arrangement portion 14 of the yoke 12 and the first magnet 8 as well as the second magnet 9 is formed as a magnetic gap 15.

A coil bobbin 16 having a cylindrical shape is arranged inside the frame 2 and a portion on the rear end side of the coil bobbin 16 is supported by the insertion arrangement portion 14 so as to fit onto the insertion arrangement portion 14. The coil bobbin 16 can be moved (can be shifted) to the axial direction (front-and-back direction) with respect to the insertion arrangement portion 14. Air existing in an internal space 16*a* of the coil bobbin 16 will be compressed air with the movement of the coil bobbin 16.

A coil 17 is wound around an outer peripheral surface at a rear end of the coil bobbin 16. The coil 17 is led from portions where end portions 17*a*, 17*a* at both sides are wound and connected to the terminal 7. The coil 17 is arranged in the magnetic gap 15.

The coil 17 is arranged in the magnetic gap 15, thereby forming a magnetic circuit by the first magnet 8, the second magnet 9, the yoke 12 and the coil 17.

A damper 18 is attached at an intermediate part of the coil bobbin 16 in the axial direction. The damper 18 is formed to be thin in an approximately annular-shape which can be elastically deformed, in which an inner peripheral portion is attached to an outer peripheral surface of the coil bobbin and an outer peripheral portion is attached to an inner surface of the step 5*c* of the frame 2. The damper 18 is elastically deformed when drive current is supplied to the coil 17 and the coil bobbin 16 is moved in the axial direction, having a function of suppressing excessive movement of the coil bobbin 16 in the axial direction.

A cone 19 is attached at a front end of the coil bobbin 16. An inner peripheral portion of the cone 19 is attached to the front end of the coil bobbin 16 and an outer peripheral portion thereof is attached to an outer peripheral portion of the opening 5*a* in the large-diameter base portion 5 of the frame 2. Therefore, the cone 19 vibrates so that a front end serves as a fulcrum with the movement of the coil bobbin 16 in the axial direction.

A sound absorbing material 20 is arranged inside the coil bobbin 16. The sound absorbing material 20 is formed, for example, in a column shape having a short length in the axial direction. The sound absorbing material 20 is made of, for example, foamed materials having pores inside such as urethane, polyethylene, rubber and styrol, which are materials not having air permeability. The sound absorbing material 20 is arranged inside the coil bobbin 16 at a front end, and the internal space 16*a* of the coil bobbin 16 is blocked by the sound absorbing material 20 and the insertion arrangement portion 14 of the yoke 12.

[Operation of the Speaker Unit]

When drive current is supplied to the coil 17 in the speaker unit 1 configured as the above, thrust is generated in the magnetic circuit, the coil bobbin 16 is moved in the front and back direction (axial direction) and the cone 19 vibrates with the movement of the coil bobbin 16. At this time, output of sound in proportion to electric current, namely, output of sound outputted from the digital music player 100 and amplified by the amplifier 60 is performed.

Air is compressed in accordance with movement of the coil bobbin 16 in the internal space 16*a* of the coil bobbin 16, and the compressed air is absorbed by the sound absorbing material 20. Therefore, the excessive increase of output in the high-frequency domains is suppressed.

When the coil bobbin 16 is moved, the damper 18 is elastically deformed with the movement of the coil bobbin 16, and electromagnetic brake is not generated as the speaker unit is the current-driven type speaker unit, therefore, oscillation due to resonance in the lowest resonance frequency domain may occur by the deformation of the damper 18.

However, the sound absorbing material 20 functioning as a cap for blocking the sealed internal space 16*a* is arranged inside the coil bobbin 16 in the speaker unit 1, therefore, resistance of air existing around the coil bobbin is maintained and oscillation in the lowest resonance frequency domain can be suppressed.

[Modification Example of the Speaker Unit]

Figure 6:
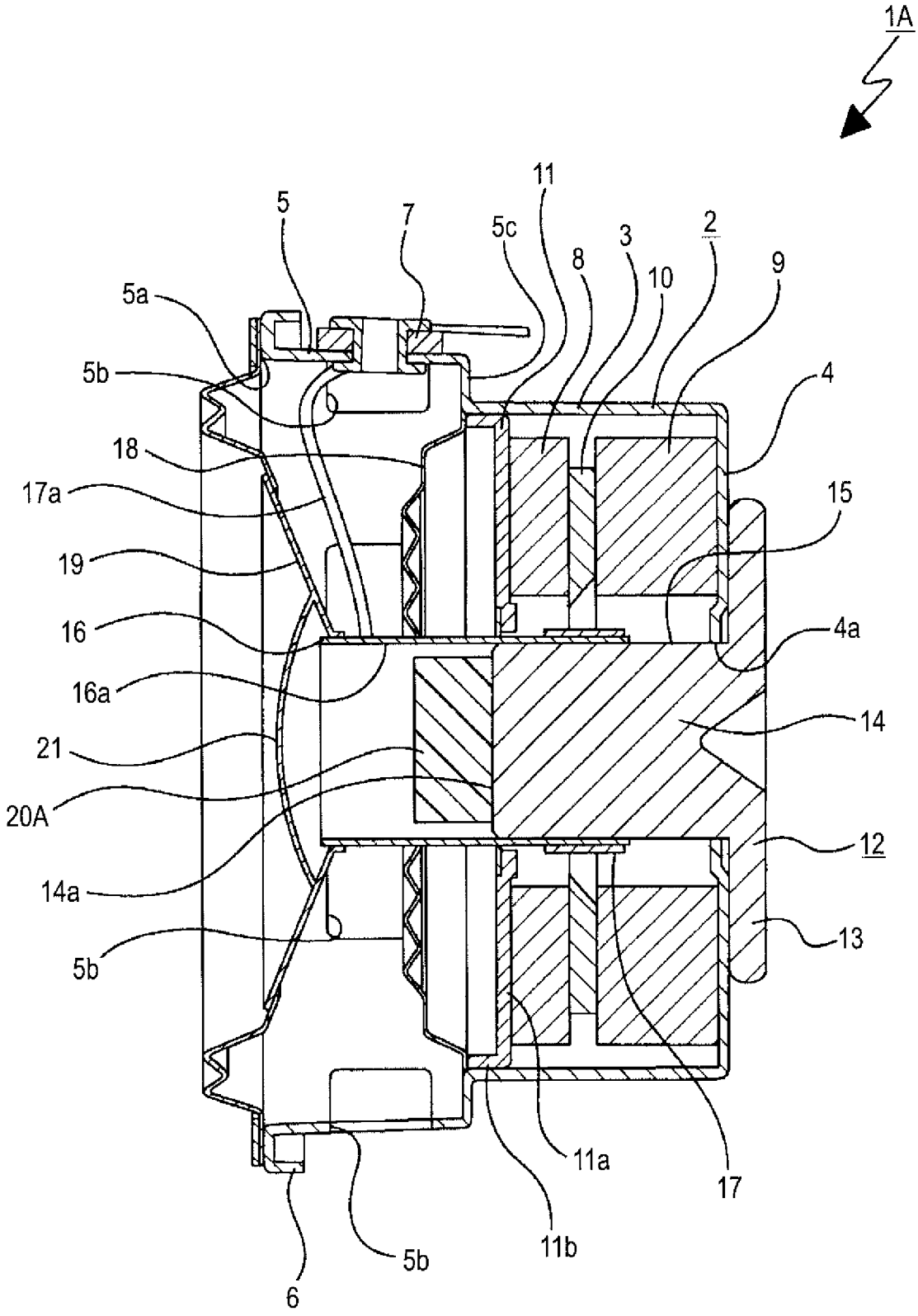
FIG. 6 is an enlarged cross-sectional view of a speaker unit according to a modification example.

Hereinafter, a speaker unit 1A according to a modification example will be explained (refer to FIG. 6).

The speaker unit 1A shown below differs from the above-described speaker unit 1 only in a position where the sound absorbing material is arranged and a size thereof, therefore, only portions different from the speaker unit 1 will be explained in detail, and the same signs given to the same portions in the speaker unit 1 are given to other portions, explanation of which is omitted.

A sound absorbing material 20A is arranged inside the coil bobbin 16. The sound absorbing material 20A is formed, for example, in a column shape having a short length in the axial direction so as to have an outer diameter slightly smaller than the sound absorbing material 20. The sound absorbing material 20A is attached to an edge surface 14*a* in the insertion arrangement portion 14 of the yoke 12.

The sound absorbing material 20A is made of, for example, foamed materials having pores inside such as urethane, polyethylene, rubber and styrol, or felt, wool and so on, namely, any of materials having air permeability or materials not having air permeability is used.

A cap 21 is fixed at a position close to an inner circumference of the cone 19, and the internal space 16*a* is blocked by the cap 21 and the insertion arrangement portion 14. The cap 21 is made of, for example, metal materials such as magnesium and aluminum, cloth materials, paper materials and so on. The cap 21 can be fixed to the front end of the coil bobbin 16.

When drive current is supplied to the coil 17 in the speaker unit 1A configured as the above, thrust is generated in the magnetic circuit, the coil bobbin 16 is moved in the front-and-back direction (axial direction) and the cone 19 vibrates with the movement of the coil bobbin 16. At this time, output of sound in proportion to electric current, namely, output of sound outputted from the digital music player 100 and amplified by the amplifier 60 is performed.

Air is compressed in accordance with movement of the coil bobbin 16 in the internal space 16*a* of the coil bobbin 16, and the compressed air is absorbed by the sound absorbing material 20A. Therefore, the excessive increase of output in the high-frequency domains is suppressed.

When the coil bobbin 16 is moved, the damper 18 is elastically deformed with the movement of the coil bobbin 16, and electromagnetic brake is not generated as the speaker unit 1A is the current-driven type speaker unit, therefore, oscillation due to resonance in the lowest resonance frequency domain may occur by the deformation of the damper 18.

However, the cap 21 for blocking the sealed internal space 16*a* is provided inside the coil bobbin 16 in the speaker unit 1A, therefore, resistance of air existing around the coil bobbin 16 is maintained and oscillation in the lowest resonance frequency domain can be suppressed.

[Outline]

As described above, the sound absorbing materials 20, 20A are arranged inside the coil bobbin 16 in the active speaker device 70 and the speaker units 1, 1A, therefore, excessive increase of output in the high-frequency domains does not occur also in the current-driven type units, which can improve sound quality in the high-frequency domains.

The excessive increase of output in the high-frequency domains is suppressed as described above, thereby realizing improvement of a dynamic range, improvement of transient response characteristics, reduction of phase variation, elimination of effects by impedance variation and improvement of controllability.

Furthermore, the sound absorbing material 20 functioning as a cap for blocking the sealed internal space 16*a* is arranged inside the coil bobbin 16 in the speaker unit 1, therefore, oscillation in the lowest resonance frequency domain can be suppressed and sound quality can be further improved.

On the other hand, the cap 21 for blocking the sealed internal space 16*a* is provided inside the coil bobbin in the speaker unit 1A, therefore, oscillation in the lowest resonance frequency domain can be suppressed and sound quality can be further improved.

Additionally, the foamed materials having pores inside are used as the sound absorbing materials 20, 20A, therefore, compressed air is positively absorbed as well as sound quality can be improved without causing rise in manufacturing costs as the foamed materials are inexpensive.

Note that specific shapes and structures of respective components shown in the above embodiment are merely examples of embodiments when carrying out the technology, and the technical scope of the present disclosure should not be interpreted in a limitative manner according to the examples.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker unit performing sound output in proportion to electric current by current driving comprising:

a frame having an opening which opens at least to an output direction of sound;

a magnet arranged inside the frame and formed in an annular shape;

a yoke including a shaft-shaped insertion arrangement portion which is inserted into a center of the magnet and arranged there;

a coil bobbin formed in a cylindrical shape and can be moved in an axial direction of the insertion arrangement portion in a state where part of the coil bobbin is fitted onto the insertion arrangement portion of the yoke;

a coil wound around an outer peripheral surface of the coil bobbin and arranged in a magnetic gap formed by the magnet and the insertion arrangement portion of the yoke;

a damper having elasticity and connected between the frame and the coil bobbin;

a cone connected to the coil bobbin at an inner peripheral portion and fixed to an opening edge of the opening of the frame at an outer peripheral portion, which vibrates with movement of the coil bobbin; and a sound absorbing material arranged inside the coil bobbin.

2. The speaker unit according to claim 1, wherein the sound absorbing material is provided as a cap attached to the coil bobbin and blocking an internal space of the coil bobbin from the opposite side of the insertion arrangement portion.

3. The speaker unit according to claim 1, wherein the sound absorbing material is attached to one end surface of the insertion arrangement portion in the axial direction, and a cap for blocking an internal space of the coil bobbin is attached to one end surface of the coil bobbin in the axial direction or the cone.

4. The speaker unit according to claim 1, wherein foamed materials having pores inside are used as the sound absorbing material.

5. An active speaker device comprising:

an amplifier performing sound output in proportion to electric current by current driving; and a speaker unit outputting sound amplified by the amplifier, wherein the speaker unit performing sound output in proportion to electric current by current driving includes a frame having an opening which opens at least to an output direction of sound, a magnet arranged inside the frame and formed in an annular shape, a yoke including a shaft-shaped insertion arrangement portion which is inserted into a center of the magnet and arranged there, a coil bobbin formed in a cylindrical shape and can be moved in an axial direction of the insertion arrangement portion in a state where part of the coil bobbin is fitted onto the insertion arrangement portion of the yoke, a coil wound around an outer peripheral surface of the coil bobbin and arranged in a magnetic gap formed by the magnet and the insertion arrangement portion of the yoke, a damper having elasticity and connected between the frame and the coil bobbin, a cone connected to the coil bobbin at an inner peripheral portion and fixed to an opening edge of the opening of the frame at an outer peripheral portion, which vibrates with movement of the coil bobbin, and a sound absorbing material arranged inside the coil bobbin.

* * * * *